United States Patent [19]

Weise

[11] Patent Number: 4,782,948

[45] Date of Patent: Nov. 8, 1988

[54] GOLF BAG AND SUPPORT THEREFOR

[76] Inventor: Kenneth E. Weise, P.O. Box 1320, La Quinta, Calif. 92253

[21] Appl. No.: 135,672

[22] Filed: Dec. 21, 1987

[51] Int. Cl.[4] ..... A63B 55/00

[52] U.S. Cl. ..... 206/315.7; 248/96

[58] Field of Search ..... 206/315.7; 248/96

[56] References Cited

U.S. PATENT DOCUMENTS

| | | | |
|---|---|---|---|
| 1,384,078 | 7/1921 | May | 206/315.7 |
| 1,606,113 | 11/1926 | Walcott | 206/315.7 |
| 1,621,329 | 3/1927 | Malone | 206/315.7 X |
| 1,683,838 | 9/1928 | Mooney | 206/315.7 |
| 1,715,101 | 5/1929 | Shanahan | 206/315.7 |
| 1,715,668 | 6/1929 | Mooney | 206/315.7 X |
| 1,904,731 | 4/1933 | Harris | 206/315.7 |
| 2,275,297 | 3/1942 | Hearnshaw | 206/315.7 X |

FOREIGN PATENT DOCUMENTS

| | | | |
|---|---|---|---|
| 201454 | 8/1923 | United Kingdom | 206/315.7 |

*Primary Examiner*—William Price

*Attorney, Agent, or Firm*—John H. Crowe

[57] ABSTRACT

A golf bag having a chamber in its base for housing four stabilizing rods. Each of the rods has inturned teeth extending from one end for a portion of its length. A pinion is mounted in the chamber to rotate around an axis coincident with the axial center of the golf bag. The four stabilizing rods are positioned so that their toothed segments mesh with the pinion. The chamber has a sidewall with four openings, each positioned to permit passage of a separate one of the four stabilizing rods. The rods are positioned in parallel pairs, each pair being disposed at 90° to the other pair. The pinion has a shaft affixed to it which extends upwardly through the center of the golf bag to an upper end fitted with a knob. The four stabilizing rods are each of the proper length to travel between one extreme position in which it extends outwardly through one of the openings to stabilize the golf bag against tipping over when the bag is standing on a horizontal surface and an opposite extreme position in which it is substantially withdrawn into the chamber. The knob on the shaft connected to the pinion is turned in one direction to simultaneously move the stabilizing rods to their bag stabilizing positions and in the other direction to cause the rods to be pulled back into their retracted positions in the chamber at the base of the golf bag.

8 Claims, 1 Drawing Sheet

GOLF BAG AND SUPPORT THEREFOR

BACKGROUND OF THE INVENTION

This invention relates generally to golf bags, and more particularly to such bags with built-in stabilizing means for supporting them in an upright or standing position on a horizontal surface.

Applicant does not profess to be the first to conceive of the idea of providing a golf bag with stabilizing means adjustable between a supporting mode adapted to maintain a bag in a standing position and a carrying and storage mode in which it can be compactly stowed in a car trunk or the like for transportation, or put away in a place of storage. Early disclosures of such means can be found in U.S. Pat. Nos. 1,606,113 to Walcott; 1,715,1O1 to Shanahan; 1,715,668 to Mooney; 1,904,731 to Harris; 1,918,447 to Blatz and 2,275,297 to Hearnshaw. A review of these patents will reveal that each of the first five discloses a mechanical contrivance for attachment to or incorporation in a golf bag which has a plurality of members movable between outspread positions of support for the golf bag and either vertical or steeply angular positions relative to the horizontal (when the bag is upright) to allow compact stowage of the bag in a car trunk for carrying and otherwise contribute to its convenient handling and storage. Each of these prior art expedients involves the movement of stabilizing legs or the like in two dimensions and requires the use of mechanical hardware inherently subject to malfunction and/or breakdown to accomplish such compound movement. The sixth one of the above-listed patents (to Hearnshaw) shows golf bag support means comprising four "wings" that are movable between extended positions to support the bag in upright position and folded positions under the bottom of the bag when support is not needed. This too involves movement of bag stabilizing members in two dimensions with concomitant need for cooperating parts and hardware subject to wear and potential breakdown. Possibly for this reason, none of the golf bag stabilizing or standing support systems in any of the above-noted patents is presently in commercial use insofar as I am aware. Nor has any golfer with whom I have discussed this matter ever heard that such a golf bag support device or feature has ever been commercially available at any time, now or in the past. The fact that prior art attempts have been made to provide golfers with means for holding golf bags in a standing position as desired without adversely affecting the transportation and handling characteristics of such bags attests to the existence of a long standing need for a solution to this problem. This need was obviously recognized before Walcott (the patentee of the oldest of the above-listed patents) came up with his proposed solution and subsequently filed his patent application (in 1925).

SUMMARY OF THE INVENTION

I have now, by this invention, provided a golf bag with built-in means convertible between an "extended" mode for maintaining the bag in a standing position and a "retracted" mode in which it is concealed in a special compartment at the bottom of the bag to permit handling, carrying and storage of the bag as easily as in the case of a conventional golf bag. Briefly, I have accomplished this by providing a plurality of stabilizer rods or arms that can be retracted within a chamber at the bottom of the golf bag during transportation and storage of the bag and moved horizontally outwardly to positions of extension around the base of the bag to stabilize it against tipping over when it is standing on the ground. This means for achieving golf bag stability in a standing position differs fundamentally from any prior art means of accomplishing the same result of which I am aware. As I have already indicated, and a review of the prior art patents listed above will show, the golf bag supporting means disclosed in each of those patents relies upon a mechanism to move a plurality of "legs" between positions of outward extension from a golf bag and retracted positions of some sort where they do not interfere with normal carrying and handling of the bag. In each case, these legs comprise components of mechanical systems to permit movement thereof in two dimensions between their extended and retracted positions. Various hardware components are used in these systems, including hinges, springs, clamps, bell crank levers, etc.

As will now be apparent, the unique golf bag stabilizing means of the present invention differs fundamentally from any of the prior art stabilizing systems discussed above in the character of movement of a plurality of stabilizing rods or arms between positions of extension from the bottom of a golf bag and retraction within a chamber at the bottom of the bag. These stabilizing rods are mounted to move only linearly, rather than angularly through two dimensions, thus simplifying the actuating mechanism for their movement. As will be seen, this mechanism is a simple gearing arrangement in which the stabilizing rods are at least partially formed with gear teeth that are meshed with a pinion such fashion as to move in outward extension from the golf bag when the pinion is turned in one direction and inwardly into the aforesaid chamber at the bottom of the bag when the direction of rotation of the pinion is reversed. The pinion is mounted within that chamber so as to rotate around a vertical axis when the golf bag is standing upright, and it has a shaft affixed to it which extends upwardly through the center and out the top of the golf bag. This shaft can be turned to rotate the pinion in either one direction or the other to move the stabilizing rods out of or back into the aforesaid chamber. As my drawing will show, this gearing arrangement is simple and easy to operate with a minimum of difficulty and coupled with the simple linear travel of my stabilizing arms minimizes the risk of malfunctioning, fatigue and deterioration through wear of the involved parts to insure virtually trouble-free operation of my golf bag stabilizing means.

DESCRIPTION OF THE PREFERRED EMBODIMENT

Figure 1:
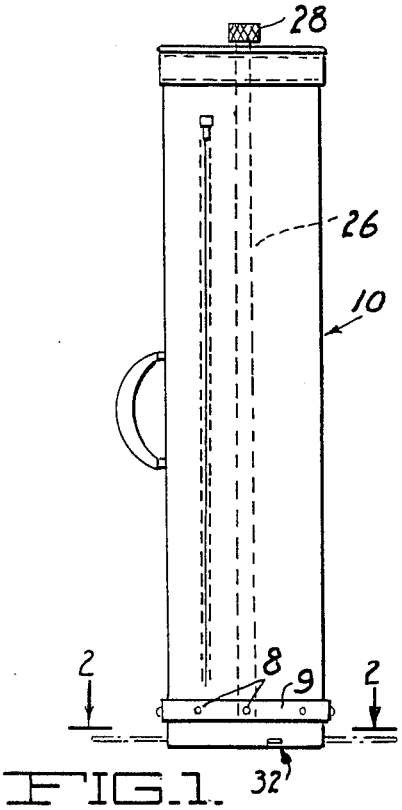
FIG. 1 is a side elevational view of a golf bag fitted with the stabilizing means of this invention, the outer portions of two stabilizing rods comprising key parts thereof being shown in phantom lines in extended positions of use.

Considering now, the drawing in greater detail, there is shown at 10 a golf bag provided with a chamber 12 at its base. This chamber is formed with a round, flat bottom 13 and a cylindrical sidewall 15 and is enclosed at the top by the bottom of the bag proper, shown at 16. A stiffening ring 9 encircles the bag near its bottom and is firmly fastened to the bag with rivets 8.

Figure 3:
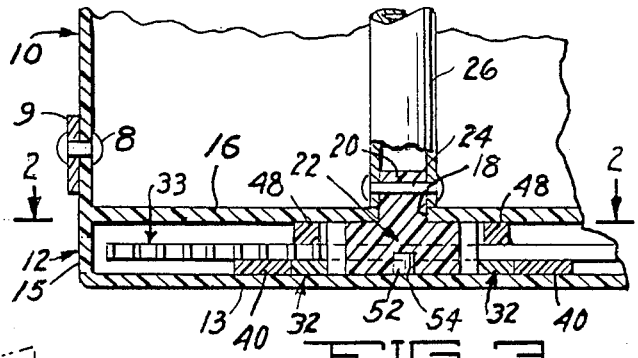
FIG. 3 :s a fragmentary view, mostly in section, of the bottom of the bag taken along line 3—3 of FIG. 2.

The bottom 16 of the golf bag proper has an opening 18 adapted to receive the reduced upper portion 20 of a pinion 22 in bearing relationship. Fixedly secured to reduced upper portion 20 of the pinion by means of a rivet 24 is a hollow shaft 26. Shaft 26 extends upwardly through the center of the golf bag and out of its top. It is fitted with a knob 28 by means of which the shaft and pinion 22 can be rotated. The shaft can be steadied at the top by a spider or the like, not shown, if desired. Meshing with pinion 22 are two rack members 32 which are mounted in parallel relationship in chamber 12. Two other rack members 33, similar to rack members 32, are also mounted in chamber 12 in meshing relationship with pinion 22, but at 90° with the latter, and above them, as seen in FIG. 3.

Figure 2:
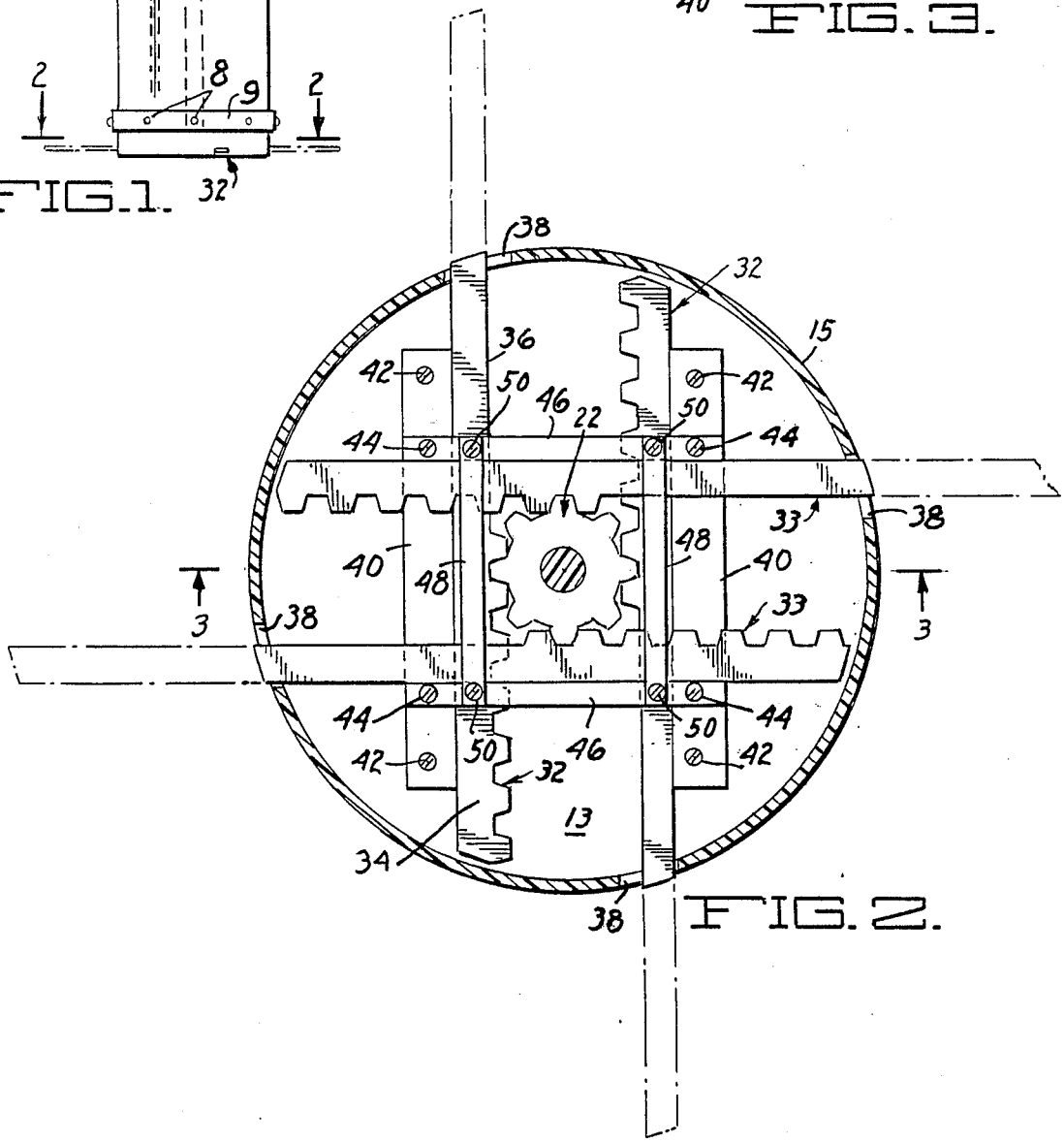
FIG. 2 is an enlarged cross-sectional view of the base of the golf bag taken along line 2—2 of FIGS. 1 and 3.

Each of the rack members has a toothed segment of sufficient length to engage the teeth of the pinion throughout the range of travel of that member, the remaining portion of the rack member being free of teeth. See FIG. 2, where the toothed segment of one of the racks is shown at 34 and the remaining, tooth-free segment at 36. The length of each of the rack members is such that in one extreme of position it fits almost entirely within chamber 12, as illustrated in solid lines in FIG. 2. The arrangement of rack members 32 and 33 within the chamber is such that rotation of the pinion 22 clockwise, as seen in FIG. 2, causes it to urge each of the four rack members in the right direction for its tooth-free segment to pass outwardly through one of four openings 38 in sidewall 15 of chamber 12 to a position illustrated by phantom lines in FIG. 2. When the rack members are so positioned, they serve as stabilizing bars or arms to maintain the golf bag upright when it stands on the ground, or other supporting surface, by preventing it from tipping over. A pair of parallel guide bars 40 are disposed outboard of rack members 32 to maintain the latter in meshing contact with pinion 22 and help guide their movements in use. These guide bars are fastened to the bottom 13 of chamber 12 by means of four screws 42. Fixedly secured to the guide bars 40 by means of four screws 44 are two smaller guide bars 46. The latter guide bars are positioned outboard of rack members 33, and serve the same purpose of restraining and guiding them in their movements as guide bars 40 serve with respect to rack members 32. To prevent upward displacement of the rack members 33 from their proper positions, a pair of ribs 48 are positioned as illustrated in FIG. 2 of the drawing. These ribs are fastened at their ends to the guide bars 46 by means of four screws 50.

A spindle 52 extends upwardly from the center of the bottom 13 of chamber 12 and concentrically into pinion 22 to help stabilize the position of that gear for optimum serviceability and durability of the golf bag support mechanism. A properly positioned socket 54 in pinion 22 receives the spindle in bearing relationship to permit substantially friction-free turning of the pinion therearound.

While the principal components of my golf bag stabilizing mechanism are shown to be of plastic construction in the drawing, it should be understood that my invention is not limited to such construction, and those parts can be made of any suitable material, or materials, such as metal, wood, or the like. The movable parts of the mechanism are shown in abutment with adjacent parts or structure in the drawing but it should, of course, be understood that the mechanism is designed to permit relative movement therebetween with minimal frictional drag through the use of construction materials with low coefficients of friction or other state of the art technique or techniques.

As will now be clear, when shaft 26 is turned by knob 28 to move pinion 22 in a clockwise direction of rotation, as seen in FIG. 2, rack members 32 will move in opposite directions until their tooth-free portions extend outwardly through openings 38 in sidewall 15 of chamber 12 to their phantom line positions in that figure, and rack members 33 move in opposite directions so that their tooth-free segments extend through other openings 38 to their phantom line positions, also shown in FIG. 2. When the rack members extend outwardly from the bottom of the golf bag in this fashion, the serve in the nature of outthrust stays to prevent the bag from tipping and thus maintain it in an upright position on the ground or other horizontal surface. Turning the shaft 26, through its knob, in the opposite direction of rotation causes the rack members to withdraw into chamber 12 and thus present no impediment to placement of the bag in a confining space, such as a car trunk, or the like, for easy handling and storage without risk of injury or damage to anyone or anything by the projecting rack members.

While this invention has been herein described and illustrated in terms of reference to a preferred embodiment, it will be understood that the invention is not limited to that particular embodiment but is broad enough in scope to include modifications thereof so long as they are encompassed by the language of the following claims.

I claim:

1. A golf bag with built-in stabilizing means adjustable between a stabilizing mode in which it maintains the bag in an upright position on a horizontal surface and one in which it is compacted for easy handling and storage of said bag, comprising:

chamber means situated at the bottom of the golf bag;

rack and pinion means comprising a pinion and a plurality of elongate rack members housed in said chamber means, each of said rack members being meshed with said pinion and the pinion being coaxial with the golf bag;

said chamber means having an encircling sidewall with a plurality of opening sized and positioned to permit passage through each of an outer segment of a separate one of said rack members;

retaining and guide means for confining said rack members to movement back and forth between positions of extension from said chamber means through said openings to prevent tipover of said golf bag when it is standing on a horizontal surface and positions of retraction substantially within said chamber means, said rack members being of such length as to permit this;

shaft means fixedly secured to said pinion and extending upwardly through the center of said golf bag to termination at a point where it can be turned by hand to rotate said pinion;

whereby rotation of said shaft means in one direction results in movement of said rack members outwardly through said openings to said positions of extension from said chamber means and rotation of the shaft means in the opposite direction causes withdrawal of said rack members substantially within said chamber means.

2. A golf bag in accordance with claim i in which said plurality of rack members comprises four rack members.

3. A golf bag in accordance with claim 2 in which the four rack members are two pairs of parallel rack members.

4. A golf bag in accordance with claim 3 in which each of the rack members has a toothed segment and a tooth-free segment and its tooth-free segment extends outwardly through a cooperating one of said openings when said stabilizing means is in its bag stabilizing mode.

5. A golf bag in accordance with claim 4 in which said shaft means includes a knob at the top to permit manual rotation thereof for outward or inward movement of said rack members.

6. A golf bag in accordance with claim 3 in which the two pairs of parallel rack members are disposed at 90° to each other.

7. A golf bag in accordance with claim 4 in which the two pairs of parallel rack members are disposed at 90° to each other.

8. A golf bag in accordance with claim 5, in which the two pairs of parallel rack members are disposed at 90° to each other.

* * * * *

UNITED STATES PATENT AND TRADEMARK OFFICE

CERTIFICATE OF CORRECTION

PATENT NO. : 4,782,948

DATED : November 8, 1988

INVENTOR(S) : KENNETH E. WEISE

It is certified that error appears in the above-identified patent and that said Letters Patent is hereby corrected as shown below:

Column 2, line 32, insert --in-- after "pinion"; and line 61, change ":s" to --is--. Column 4, line 49, "opening" should be --openings--. Column 5, line 3, change "i" after "claim" to --1--.

Signed and Sealed this

Twenty-first Day of March, 1989

*Attest:*

DONALD J. QUIGG

*Attesting Officer*

*Commissioner of Patents and Trademarks*